US005881952A

United States Patent [19]

MacIntyre

[11] Patent Number: 5,881,952

[45] Date of Patent: Mar. 16, 1999

[54] HEATER FOR LIQUIDS

[76] Inventor: Kenneth R. MacIntyre, 13 Bernet Street, Oakville, Ontario, Canada, L16K 1B5

[21] Appl. No.: 114,890

[22] Filed: Jul. 14, 1998

[51] Int. Cl.[6] ..... F24H 3/06

[52] U.S. Cl. ..... 237/7; 237/19

[58] Field of Search ..... 237/7, 8 R, 8 B, 237/56, 19

[56] References Cited

U.S. PATENT DOCUMENTS 4,848,655 7/1989 Woodin et al. ..... 237/8 R 5,772,113 6/1998 Gerstmann et al. ..... 237/8 R

*Primary Examiner*—Henry Bennett

*Assistant Examiner*—Derek S. Bales

[57] ABSTRACT

A heating system is provided with a closed circuit system for a first liquid, a pass-through system for a second liquid and a controller. The closed circuit system has a primary heater with a first heat exchanger, a second heat exchanger and a circulating pump. The primary heater has a burner for burning hydrocarbon fuel and has a first heat exchanger for transferring heat from combustion products of hydrocarbon fuel to the first liquid. The second heat exchanger allows transfer of heat from the first liquid heated in the first heat exchanger to the second liquid in the pass-through system. The closed systems also has an outlet pipe connecting an outlet of the first heat exchanger to an inlet of the second heat exchanger, and an inlet pipe connecting an inlet of the first heat exchanger to an outlet of the second heat exchanger. The pass-through system has a storage tank, a recirculating tube system with recirculating pump, a main second liquid supply, a withdrawal tube and a fast response temperature sensor. The recirculating tube connects an inlet to an outlet of the storage tank via the second heat exchanger. The withdrawal tube is connected to the recirculating tube, for withdrawal of hot liquid from the pass-through system. The main second liquid supply line is connected to the recirculating tube upstream of the second heat exchanger. The temperature sensor is for sensing the temperature of second liquid in the recirculating tube between the main supply line and the second heat exchanger. The controller has means for detecting a substantial temperature drop caused by an in-flow of second liquid from the main supply line, as sensed by the temperature sensor, and has means for causing the hydrocarbon fuel to be burnt in order to heat the first liquid in the first heat exchanger.

11 Claims, 2 Drawing Sheets

HEATER FOR LIQUIDS

FIELD OF THE INVENTION

The present invention relates to an improved heater for liquids. In particular it relates to a heater for water and especially a combination heater for a closed circuit heating system and a hot water supply system.

BACKGROUND TO THE INVENTION

Hot water heating systems are known. A common system used in North America includes a large water storage tank which has means for heating the water in the tank prior to discharge, for example to a sink, washing machine or the like. The water in such storage tanks are usually heated with electric heating coils or by burning hydrocarbon gas. Such storage tanks are advantageous because they can provide large amounts of hot water. In Europe, systems are used for rapidly heating cold water by passing the water through a coiled copper pipe which is positioned in a heating device. Such systems are relatively efficient but tend to be unable to provide large amounts of hot water. A combination of the two systems is shown in Canadian Patent Application 2 125 070 to R. W. Smith, which was published on Dec. 1, 1995. Basically, the Smith system uses a separate single-pass heater to supply hot water to a water tank. One of the limitations of the Smith invention is the deposition of solids from potable water onto wetted heating surfaces.

The present invention is intended to provide a compact improved apparatus for supplying hot water to a tank and to alleviate the aforementioned difficulties, e.g. substantially overcome the problems caused by deposition of solids from the water.

SUMMARY OF THE INVENTION

Accordingly the present invention provides a heating system which has a closed circuit system for a first liquid, a pass-through system for a second liquid and a controller, in which the closed circuit system comprises:

i) a primary heater for the first liquid which has a burner for burning hydrocarbon fuel and has a first heat exchanger for transferring heat from combustion products of hydrocarbon fuel to the first liquid in the closed circuit system;

ii) a second heat exchanger for transferring heat from the first liquid heated in the first heat exchanger to the second liquid in the pass-through system;

iii) an outlet pipe connecting an outlet of the first heat exchanger to an inlet of the second heat exchanger, and an inlet pipe connecting an inlet of the first heat exchanger to an outlet of the second heat exchanger;

iv) a first pump for circulating first liquid through the inlet pipe, the first heat exchanger, the outlet pipe and the second heat exchanger;

and in which the pass-through system comprises:

i) a storage tank for second liquid;

ii) a recirculating tube which connects an inlet to an outlet of the storage tank via the second heat exchanger;

iii) at least one hot second liquid supply tube connected to the recirculating tube, for withdrawal of hot second liquid from the pass-through system;

iv) a main second liquid supply line connected to the recirculating tube upstream of the second heat exchanger;

v) a first fast response temperature sensor for sensing the temperature of second liquid in the recirculating tube between the main supply line and the second heat exchanger; and vi) a second pump for circulating second liquid through the storage tank, recirculating tube and second heat exchanger;

and in which the controller comprises means for detecting a substantial temperature drop caused by an in-flow of second liquid from the main supply line and sensed by the first temperature sensor, and means for causing the hydrocarbon fuel to be burnt in order to heat first liquid in the first heat exchanger.

In a preferred embodiment, the hydrocarbon fuel is a fluid.

In one embodiment the controller also has means for turning the first and second pumps on and off.

In a preferred embodiment there is a flow detector for detecting flow of first liquid in the closed circuit system.

In another embodiment, the closed circuit system has a second fast response temperature sensor for sensing the temperature of first liquid in the closed circuit system, and at least one space heater connected by a heater supply tube and a heater return tube to the outlet tube and the inlet tube respectively of the closed circuit system, with a three-way valve at the connection between the outlet tube and the heater supply tube; and the controller has means for operating the three-way valve so that first liquid in the closed circuit system may be diverted solely to the second heat exchanger, solely to the space heater, or to both the second heat exchanger and the space heater, depending on the temperatures of the liquids as determined by the first and second temperature sensors, relative to predetermined temperatures for the liquids in the pass-through system and in the closed circuit system.

Preferably, the controller has means for operating the three-way valve so that first liquid in the closed circuit system may be diverted solely to the second heat exchanger or solely to the space heater.

Preferably, the first and second liquids are water.

DETAILED DESCRIPTION OF PREFERRED EMBODIMENTS

Figure 1:
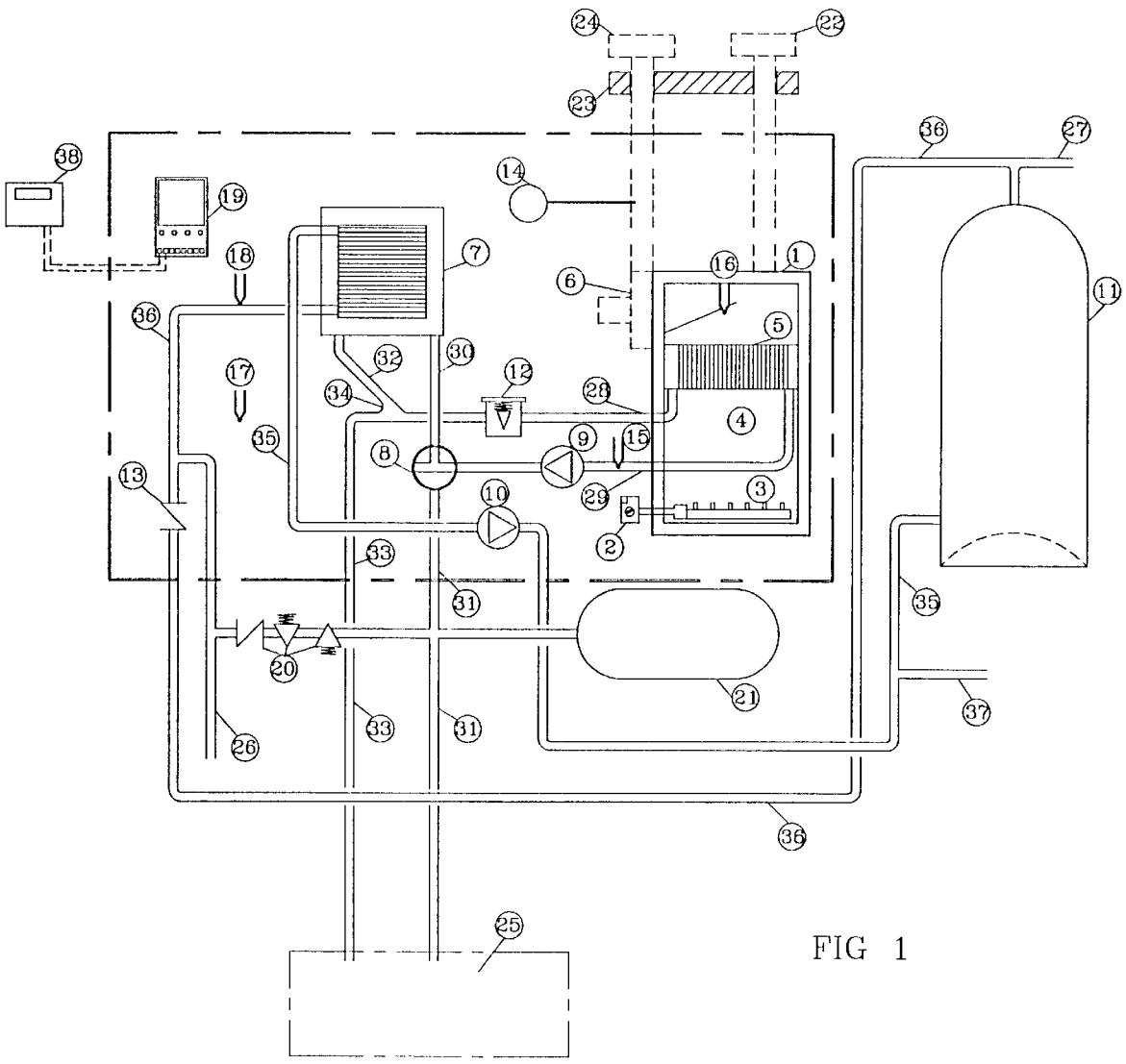
FIG. 1 is a schematic representation of one embodiment of the present invention.

The invention is illustrated first by reference to FIG. 1, in which the first and second liquids are water. In the arrangement shown, there is a closed circuit water system which passes through a primary water heater 1 and a heat exchanger 7. Optionally, the closed circuit water system may supply hot water to so-called hydronic space heaters 25. There is also a pass-through water system, in which water is fed from the main water supply 26, through heat exchanger 7 and storage tank 11 to a hot water supply line 27.

The invention will be described with reference to heating by hydrocarbon gas, but it will be understood that heating could be accomplished by burning hydrocarbon oil.

Figure 2:
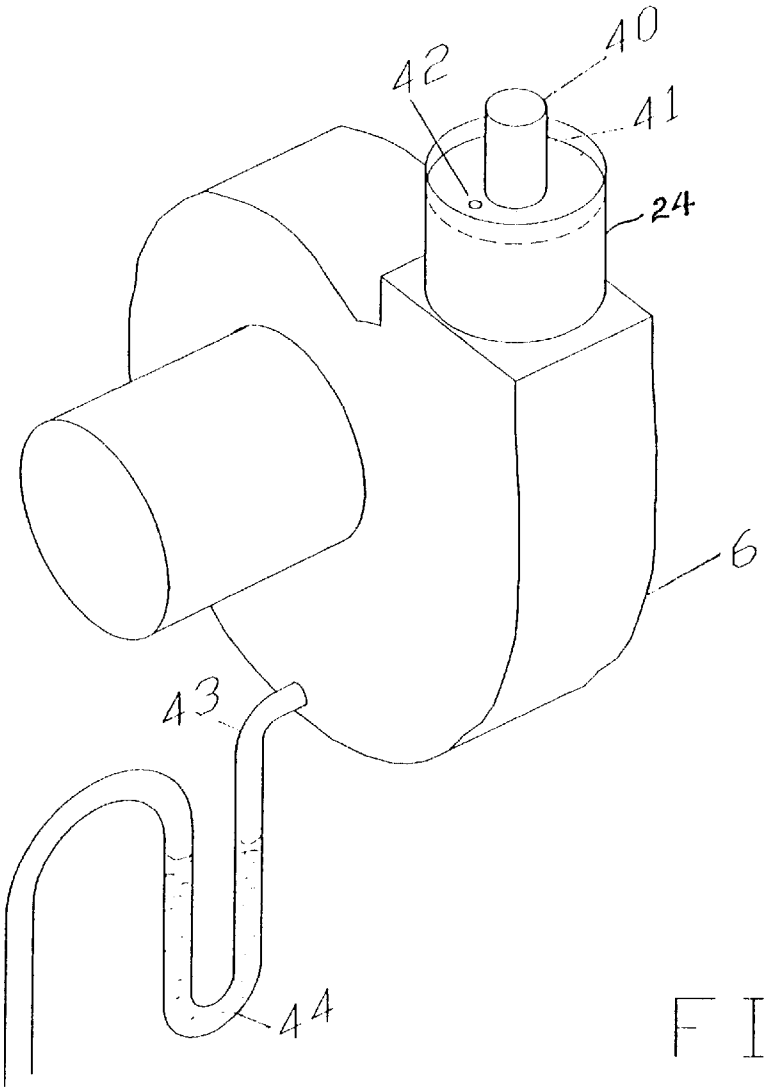
FIG. 2 shows an exhaust fan with vent orifice tube for a heater useful in the present invention.

The primary water heater 1 has a gas burner 3, which is connected to a hydrocarbon gas supply, e.g. propane, natural gas, via a controllable gas valve 2. Air for combustion is drawn into a combustion chamber through air intake 22 and flue gases are vented through flue 4 to exhaust pipe 24 by means of an exhaust fan 6. Inside flue 4 there is a tube and fin heat exchanger 5. Preferably, the air intake and exhaust pipe are coaxial, with the air intake surrounding the exhaust pipe. As the water heating system is usually in a building, the air intake 22 and exhaust pipe 24 extend outside the building through wall 23. Inside exhaust pipe 24 there may be an air proving switch 14, to ensure safe combustion of the hydrocarbon gases. For domestic water heating systems, the air intake pipe and the exhaust pipe are preferably made of acrylonitrile-butadiene-styrene copolymer (ABS) resin. There may be a vent orifice tube 40 in the exhaust pipe 24, as shown in FIG. 2.

If the output of gas valve 2 is substantially above that required for domestic hot water heating, there may be a need to modulate input to gas burner 3 in order to avoid excessive cycling. This may be accomplished by using a step modulating gas valve and a combustion fan equipped with a two-speed or multi-speed motor. Operation of the controller is as described elsewhere herein. Another form of modulation is to use a continuous modulating gas valve and/or a continuously modulating combustion fan in conjunction with the controller. The controller would enable the total system to achieve a desired response and control in accordance with the present invention.

It will be understood that water vapour in the flue gases may condense in the exhaust pipe 24. In the embodiment shown in FIG. 2, vent orifice tube 40 has an annular plate 41 surrounding the vent orifice tube 41 and which seals against the inside of exhaust pipe 24. Flue gas condensate may drain through drain hole 42 in annular plate 41. Exhaust fan 6 is preferably made of non-corroding material such as ABS resin. A drain tube 43 is located at the bottom of the housing of fan 6. Drain tube 43 has a U-trap 44 therein.

Tube and fin heat exchanger 5 has an inlet tube 28 and an outlet tube 29. Outlet tube 29 is connected to a first pump 9 and thence to a three-way valve 8 which may be controlled to direct water solely to the exchanger 7 via tube 30, solely to hydronic space heaters 25 via tube 31, or to both the heat exchanger 7 and the hydronic space heaters 25. Typical hydronic space heaters are baseboard heaters, fan coils and in-floor coils. Tube 30 is an inlet to a liquid/liquid heat exchanger 7, e.g. a tube and fin exchanger, and tube 32 is an associated outlet from heat exchanger 7. Tube 31 is an inlet to hydronic space heaters 25 and tube 33 is an associated outlet from hydronic space heaters 25. Tubes 32 and 33 are connected to tube 28 at Y-piece 34. Inserted in tube 28 is a minimum flow valve 12. In this embodiment, the closed circuit comprises the primary water heater 1, the heat exchanger 7, the hydronic space heaters 25 and the associated tubing.

Storage tank 11 has an inlet tube 35, which is connected via second pump 10 to liquid/liquid heat exchanger 7. Tube 35 is connected, through heat exchanger 7 to recirculating tube 36. Recirculating tube 36 is connected to hot water supply line 27 and to the top of storage tank 11. Recirculating tube 36 is also connected to water supply line 26 through a non-return valve 13. Water supply line 26 is connected to an expansion tank 21 via a pressure relief and fill valve 20. Tube 35 optionally has a second hot water supply line 37 connected thereto.

Operation of the system is controlled by a controller 19, which may have a thermostat 38 associated therewith. Controller 19 is an electronic control module, the function of which will be described hereinafter. In the embodiment shown in FIG. 1, controller 19 is connected to four thermocouples. Thermocouple 16 is located in the flue of primary water heater 1; thermocouple 15 is on the outside of outlet tube 29; thermocouple 17 is in ambient air, preferably near to recirculating tube 36; and thermocouple 18 is on the outside of recirculating tube 36, preferably adjacent to heat exchanger 7. It is preferable that thermocouples 15, 16, 17 and 18 have a fast response time. The fast response time minimizes overshooting and undershooting of temperature control of the water systems. Thermocouple 17 may be replaced by other temperature sensors, as the response time in ambient air is not so critical. Typically, thermocouples 15 and 18 are attached to the outside of their respective tubes by a clamp, although they may also be bonded by soldering or the like. Temperature sensors based on bimetallic strips do not have a fast enough response time for the present invention. An example of a fast response temperature sensor 18 is one in which initiation of ignition of hydrocarbon fluid occurs within about 10 seconds of the start of draw of second fluid from the system.

In operation, pump 10 circulates water through storage tank 11 and heat exchanger 7. The circulation may be continuous or may be intermittently controlled by controller 19. Continuous circulation ensures that the temperature of water in storage tank 11 is substantially uniform throughout the tank. When water is drawn from first or second hot water supply lines 27 or 37, fresh water is drawn into recirculating tube 36 from water supply line 26. As this occurs, there is a temperature drop in recirculating line 36 adjacent to heat exchanger 7. The temperature of line 36 adjacent to heat exchanger 7 is sensed by thermocouple 18. In one control method, controller 19 compares the temperatures registered by thermocouples 18 and 17 and determines a substantial temperature drop, e.g. at least 2° C. (such as from 2° C. to 4° C.), in recirculating tube 36. As a result of this temperature drop, controller 19 causes gas valve 2 to be opened. Preferably however, prior to doing so, controller 19 determines if minimum flow valve 12 indicates a sufficient flow of water through inlet tube 28 and if air proving switch 14 indicates a sufficient flow of combustion air. It will be understood that sensing sufficient water and air flow in this manner is primarily for safety purposes and for protecting the heat exchanger 5 and the associated fan 6 and exhaust tube 24 from damage. If pumps 9 and 10 are not operating, controller 19 switches both pumps on and also switches fan 6 on. After valve 2 is open, hydrocarbon gas from gas burner 3 is burnt. As will be understood, the air necessary for combustion is drawn through air intake 22. The resulting flue gases are drawn by fan 6 and exhausted through exhaust 24. Any condensate drips down the inner wall of exhaust pipe 24 and onto annular plate 44 and thence through drain hole 42 to drain tube 43. It will be understood that if there is insufficient water flow as detected by minimum flow switch 12 or if there is insufficient air flow as detected by air proving switch 14, then controller 19 will not open up valve 2.

The combustion gases from burner 3 heat water in the tube and fin heat exchanger 5. The water in such heat exchange is pumped by pump 9 through outlet pipe 29. If, as described above, water is being drawn from supply lines 27 or 37, three-way valve 8 is set by controller 19 to allow all water in tube 29 to flow though tube 30 and thence through heat exchanger 7, tube 32 and so recirculate via minimum flow valve 12 and inlet tube 28 to tube and fin heat exchanger 5. As the closed circuit water flows through tube 30, heat exchanger 7 and tube 32, heat is exchanged with water flowing through tube 36, heat exchanger 7 and tube 35. Controller 19 controls gas valve 2 in order to keep the temperature of water, as sensed by thermocouple 15, in the closed circuit between a first predetermined temperature and another predetermined temperature which is lower than the first predetermined temperature. For example, controller 19 may be set to control the temperature of water in the closed circuit system between about 68° C. and 85° C. This is done by controller 19 opening and closing gas valve 2 as appropriate. When the temperature of water in the pass-through system, as determined by thermocouple 18 reaches a second predetermined temperature, which is the desired hot water temperature of water in storage tank 11, e.g. about 57° C., controller 19 shuts off gas valve 2. Controller 19 also monitors the temperature in the flue gases as determined by thermocouple 16 and if the temperature exceeds a third predetermined temperature, gas valve 2 is closed. The third predetermined temperature is particularly required if the exhaust pipe 24 is made of a combustible material such as ABS, so that the ABS is not melted or burned.

In another control method, thermocouple 17 is not necessary, and draw of water from main water supply line 26 is detected solely by thermocouple 18. This, however, requires controller 19 to determine the rate of change in temperature sensed by thermocouple 18, in order to avoid false conclusions being made with respect to whether water is being drawn from the main water supply line 26 or not.

When water is being drawn from supply lines 27 or 37, three-way valve 8 will be positioned to supply water only to heat exchanger 7. When water is required for hydronic space heaters 25 but is not required for heat exchanger 7, three-way valve 8 is preferably set so that water will flow solely through tube 31.

As will be understood, hydronic space heaters are usually used to heat rooms. The desired temperature in the room is pre-set with thermostat 38. When there is a call for heat in the room, controller 19 first determines if there is a simultaneous call for heat for the pass-through water system. If there is, the call for heating the room is ignored until the heating requirements for the pass-through system are satisfied. Once satisfied, controller 19 ensures that pump 9 and fan 6 are on and that there is sufficient water flow as determined by minimum flow valve 12 and sufficient air flow as determined by air proving switch 14. Only then will controller 19 open gas valve 2. Gas valve 2 will be opened and closed to keep the temperature of the water in the closed water system, as determined by thermocouple 15, between two predetermined set-points, e.g. between about 68° C. and 85° C. Three-way valve 8 is set so that water flows through tube 31 to hydronic space heaters 25. In the event that water is drawn from supply lines 27 or 37, i.e. heat is required for the pass-through water system, priority is given to heating of the water for storage tank 11.

There is a check valve 13 in hot water recirculation tube 36 which ensures that when the rate of water draw at supply line 27 exceeds the capacity of pump 10, the excess is drawn as hot water from the storage tank 11 and not as cold water from the main water supply line 26.

In a domestic water situation, many jurisdictions specify a maximum temperature to which water in storage tank 11 may be heated. In some jurisdictions the maximum temperature is about 57° C.; in others it is 49° C. To accommodate requirements for different jurisdictions, the present control system may have a jumper or other means to alter the maximum temperature setting. When the exhaust pipe 24 is made of ABS copolymer, the temperature of the water in the closed circuit system is preferably no higher than about 85° C.

Notwithstanding the above reference to water as the liquids in the closed system and the pass-through system, it will be understood that the heating system of the present invention is applicable to other liquids, e.g. oils, glycols.

I claim:

1. A heating system which has a closed circuit system for a first liquid, a pass-through system for a second liquid and a controller, in which the closed circuit system comprises:

i) a primary heater for the first liquid which has a burner for burning hydrocarbon fuel and has a first heat exchanger for transferring heat from combustion products of hydrocarbon fuel to the first liquid in the closed circuit system;

ii) a second heat exchanger for transferring heat from the first liquid heated in the first heat exchanger to the second liquid in the pass-through system;

iii) an outlet pipe connecting an outlet of the first heat exchanger to an inlet of the second heat exchanger, and an inlet pipe connecting an inlet of the first heat exchanger to an outlet of the second heat exchanger; and iv) a first pump for circulating first liquid through the inlet pipe, the first heat exchanger, the outlet pipe and the second heat exchanger;

and in which the pass-through system comprises:

i) a storage tank for second liquid;

ii) a recirculating tube which connects an inlet to an outlet of the storage tank via the second heat exchanger;

iii) at least one hot second liquid supply tube connected to the recirculating tube, for withdrawal of hot second fluid from the pass-through system;

iv) a main second fluid supply line connected to the recirculating tube upstream of the second heat exchanger;

v) a first fast response temperature sensor for sensing the temperature of second liquid in the recirculating tube between the main supply line and the second heat exchanger; and vi) a second pump for circulating second liquid through the storage tank, recirculating tube and second heat exchanger;

and in which the controller comprises means for detecting a substantial temperature drop caused by an in-flow of second liquid from the main supply line and sensed by the first temperature sensor, and means for causing the hydrocarbon fuel to be burnt in order to heat first liquid in the first heat exchanger.

2. A heating system according to claim 1 wherein the primary heater has a burner for burning fluid hydrocarbon fuel and has a fuel valve for controlling flow of the hydrocarbon fuel to the burner.

3. A heating system according to claim 2 wherein the closed circuit system has a second fast response temperature sensor for sensing the temperature of first liquid in the closed circuit system; and the closed circuit system has at least one space heater connected by a heater supply tube and a heater return tube to the outlet tube and the inlet tube respectively of the closed circuit system, with a three-way valve at the connection between the outlet tube and the heater supply tube; and the controller has means for operating the three-way valve so that first liquid in the closed circuit system may be diverted solely to the second heat exchanger, solely to the space heater, or to both the second heat exchanger and the space heater, depending on the temperatures of the liquids as determined by the first and second temperature sensors, relative to predetermined temperatures for the liquids in the closed circuit system and in the pass-through system.

4. A heating system according to claim 2 wherein the first and second liquids are water.

5. A heating system according to claim 3 wherein the first and second liquids are water.

6. A heating system according to claim 2 wherein the controller also has means for turning the first and second pumps on and off.

7. A heating system according to claim 3 wherein the controller also has means for turning the first and second pumps on and off.

8. A heating system according to claim 2 wherein additionally there is a flow detector for detecting flow of first liquid in the closed circuit system.

9. A process for controlling a heating system which has a closed circuit system for a first liquid, a pass-through system for a second liquid and a controller, in which the closed circuit system comprises:

i) a primary heater for the first liquid which has a burner for burning fluid hydrocarbon fuel, a fuel valve for controlling flow of the hydrocarbon fuel to the burner, and has a first heat exchanger for transferring heat from combustion products of hydrocarbon fuel to the first liquid in the closed circuit system;

ii) a second heat exchanger for transferring heat from the first liquid heated in the first heat exchanger to the second liquid in the pass-through system;

iii) an outlet pipe connecting an outlet of the first heat exchanger to an inlet of the second heat exchanger, and an inlet pipe connecting an inlet of the first heat exchanger to an outlet of the second heat exchanger; and iv) a first pump for circulating first liquid through the inlet pipe, the first heat exchanger, the outlet pipe and the second heat exchanger;

and in which the pass-through system comprises:

i) a storage tank for second liquid;

ii) a recirculating tube which connects an inlet to an outlet of the storage tank via the second heat exchanger;

iii) at least one hot second liquid supply tube connected to the recirculating tube, for withdrawal of hot second fluid from the pass-through system;

iv) a main second liquid supply line connected to the recirculating tube upstream of the second heat exchanger;

v) a second pump for circulating second liquid through the storage tank, recirculating tube and second heat exchanger;

vi) a first fast response temperature sensor for sensing the temperature of second liquid in the recirculating tube between the main supply line and the second heat exchanger;

and in which the controller comprises means for detecting a substantial temperature drop caused by an in-flow of second liquid from the main supply line and sensed by the first temperature sensor, and means for causing the hydrocarbon fuel to be burnt in order to heat first liquid in the first heat exchanger;

wherein the process comprises the steps of:

i) sensing the temperature of the second liquid in the recirculating tube, and sensing whether or not there is a flow of first liquid in the closed circuit system; and ii) when a flow of first liquid is sensed and when a substantial drop in temperature is sensed in the second liquid, the controller causes the fuel valve to open until the temperature of the second liquid reaches a second predetermined temperature set point, at which time the controller causes the fuel valve to close.

10. A process according to claim 9 wherein the first and second liquids are water.

11. A process according to claim 9 wherein the heating system additionally has a second fast response temperature sensor for sensing the temperature of first liquid in the closed circuit water system; and the closed circuit system has at least one space heater connected by a heater supply tube and a heater return tube to the outlet tube and the inlet tube respectively of the closed circuit system, with a three-way valve at the connection between the outlet tube and the heater supply tube; and the controller has means for operating the three-way valve so that first liquid in the closed circuit system may be diverted solely to the second heat exchanger, solely to the space heater, or to both the second heat exchanger and the space heater, depending on the temperatures of the liquids as determined by the first and second temperature sensors, relative to predetermined temperatures for the liquids in the closed circuit system and in the pass-through system; and in the process, when the temperature in the closed circuit system drops below a first predetermined temperature set point the controller causes the fuel valve to open until the temperature of the second liquid reaches a second predetermined temperature set point, at which time the controller causes the fuel valve to close; and when the temperature in the space heater drops below a predetermined temperature set point, the controller cause the three-way valve to set in order to direct flow of first fluid through the space heater, unless step ii) is in operation, in which case step ii) takes priority over supply of first fluid to the space heater.

* * * * *